US007235705B2

(12) United States Patent
Stell

(10) Patent No.: US 7,235,705 B2
(45) **Date of Patent: *Jun. 26, 2007**

(54) PROCESS FOR REDUCING VAPOR CONDENSATION IN FLASH/SEPARATION APPARATUS OVERHEAD DURING STEAM CRACKING OF HYDROCARBON FEEDSTOCKS

(75) Inventor: Richard C. Stell, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 404 days.

This patent is subject to a terminal disclaimer.

(21) Appl. No.: 10/851,878

(22) Filed: May 21, 2004

(65) Prior Publication Data

US 2005/0261538 A1 Nov. 24, 2005

(51) Int. Cl.
*C07C 4/04* (2006.01)

(52) U.S. Cl. ..... 585/647; 585/652

(58) Field of Classification Search ..... 585/647, 585/652

See application file for complete search history.

(56) References Cited

U.S. PATENT DOCUMENTS

| | | | | |
|---|---|---|---|---|
| 1,936,699 | A | 11/1933 | Weaver | |
| 1,984,569 | A | 12/1934 | Cooke et al. | 196/66 |
| 2,091,261 | A | 8/1937 | Alther | 196/49 |
| 2,158,425 | A | 5/1939 | Ragatz | 196/73 |
| 3,291,573 | A | 12/1966 | Frescoln | 23/284 |
| 3,341,429 | A | 9/1967 | Fondrk | 203/95 |
| 3,413,211 | A | 11/1968 | Becraft et al. | 208/93 |
| 3,487,006 | A | 12/1969 | Newman et al. | 208/93 |
| 3,492,795 | A | 2/1970 | Guerrieri | 55/463 |
| 3,505,210 | A | 4/1970 | Wallace et al. | 208/228 |
| 3,617,493 | A | 11/1971 | Wirth et al. | 208/80 |
| 3,677,234 | A | 7/1972 | Dutkiewicz | 122/240 |
| 3,718,709 | A | 2/1973 | Simonetta | 260/683 R |
| 3,900,300 | A | 8/1975 | Lehman | |
| 4,199,409 | A | 4/1980 | Skraba | 203/39 |

(Continued)

FOREIGN PATENT DOCUMENTS

DE 1093351 11/1960

(Continued)

OTHER PUBLICATIONS

"Specialty Furnace Design: Steam Reformers and Steam Crackers", presented by T.A. Wells of the M.W. Kellogg Company, 1988 AIChE Spring National Meeting.

(Continued)

*Primary Examiner*—Thuan Dinh Dang

(57) ABSTRACT

A process for reducing fouling during cracking of a hydrocarbon feedstock containing resid is provided which comprises: introducing a mixture stream of heated hydrocarbon feedstock mixed with steam to a flash/separation apparatus to form i) a vapor phase at its dew point which partially cracks causing a temperature decrease and partial condensation of said vapor phase in the absence of added heat, and ii) a liquid phase. Partial condensation is reduced by adding a heated vaporous diluent, e.g., light hydrocarbon or superheated steam, to the flash/separation apparatus to an extent sufficient to at least partially compensate for the temperature decrease and to dilute and superheat the vapor phase, prior to removing the vapor phase as overhead for subsequent cracking and recovery of cracked product. An apparatus for carrying out the process is also provided.

24 Claims, 1 Drawing Sheet

U.S. PATENT DOCUMENTS

| | | | | |
|---|---|---|---|---|
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | |
| 4,400,182 | A | 8/1983 | Davies et al. | |
| 4,426,278 | A | 1/1984 | Kosters | 208/130 |
| 4,543,177 | A | 9/1985 | Murthy et al. | 208/130 |
| 4,615,795 | A | 10/1986 | Woebcke et al. | 208/72 |
| 4,714,109 | A | 12/1987 | Tsao | 165/104.18 |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | |
| 5,096,567 | A | 3/1992 | Paspek, Jr. et al. | 208/106 |
| 5,120,892 | A | 6/1992 | Skraba | 585/652 |
| 5,190,634 | A | 3/1993 | Fernandez-Baujin et al. | 208/107 |
| 5,468,367 | A | 11/1995 | Dickakian et al. | 208/48 |
| 5,580,443 | A | 12/1996 | Yoshida et al. | 208/130 |
| 5,817,226 | A | 10/1998 | Lenglet | |
| 5,910,440 | A | 6/1999 | Grossman et al. | |
| 6,093,310 | A | 7/2000 | Swan | |
| 6,123,830 | A | 9/2000 | Gupta et al. | |
| 6,179,997 | B1 | 1/2001 | Vedder, Jr. et al. | 208/113 |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,376,732 | B1 | 4/2002 | Ngan et al. | |
| 6,632,351 | B1 | 10/2003 | Ngan et al. | 208/132 |
| 6,743,961 | B2 | 6/2004 | Powers | |
| 2001/0016673 | A1 | 8/2001 | Bridges et al. | |
| 2003/0070963 | A1 | 4/2003 | Zimmermann et al. | 208/106 |
| 2004/0004022 | A1 | 1/2004 | Stell et al. | 208/106 |
| 2004/0004027 | A1 | 1/2004 | Spicer et al. | 208/130 |
| 2004/0004028 | A1 | 1/2004 | Stell et al. | 208/130 |
| 2004/0039240 | A1 | 2/2004 | Powers | 585/652 |
| 2004/0054247 | A1 | 3/2004 | Powers | |
| 2005/0010075 | A1 | 1/2005 | Powers | |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2006259 | 10/1977 |
| GB | 2012176 | 11/1977 |
| NL | 7410163 | 4/1975 |
| SU | 1491552 | 7/1989 |
| WO | WO 01/55280 | 8/2001 |
| ZA | 907394 | 7/1991 |

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16, date not available.

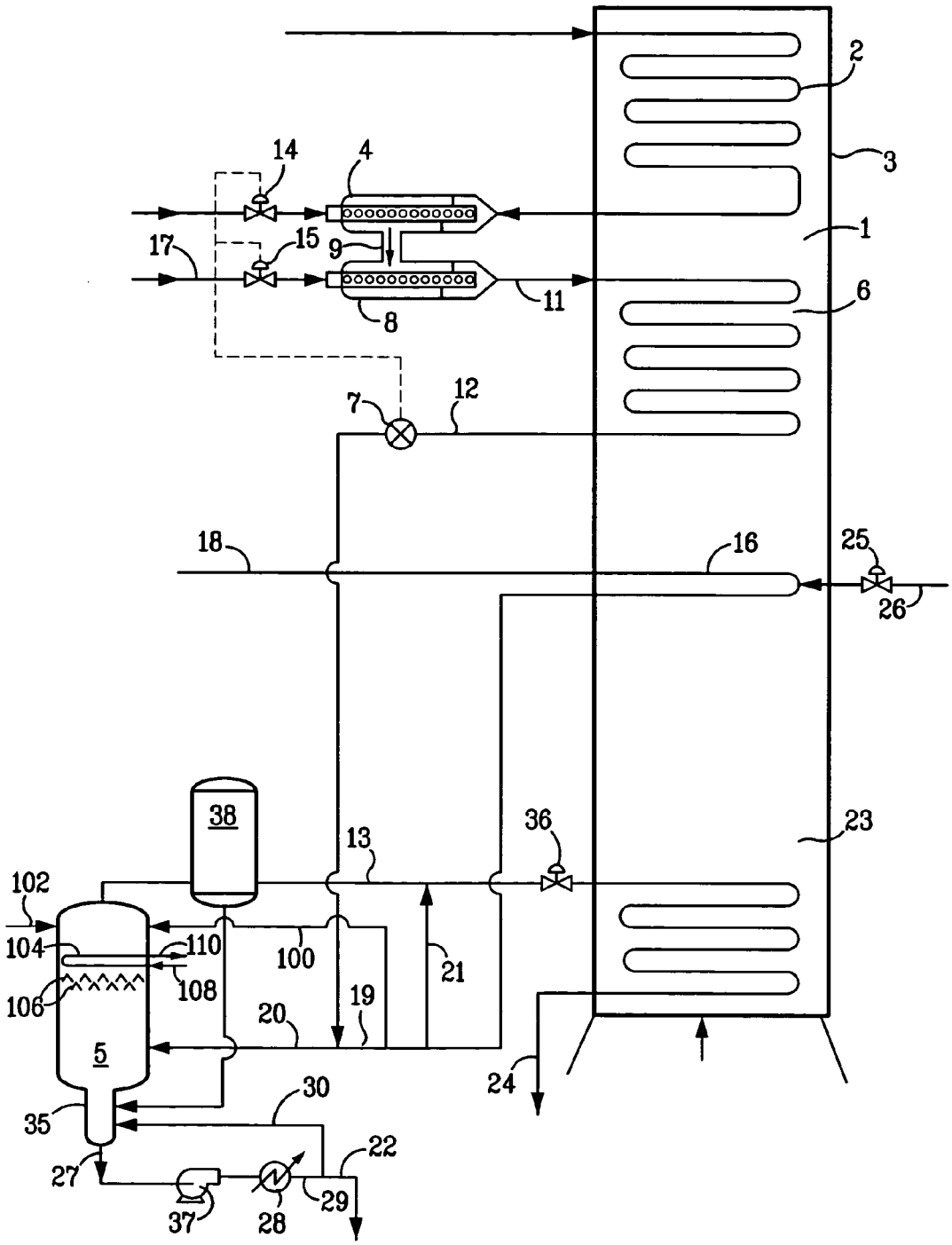
2
3
14
4
1
17
15
9
11
6
8
7
12
18
16
25
26
38
36
23
13
102
104
110
100
21
106
108
19
20
5
24
30
35
22
27
29
37
28

PROCESS FOR REDUCING VAPOR CONDENSATION IN FLASH/SEPARATION APPARATUS OVERHEAD DURING STEAM CRACKING OF HYDROCARBON FEEDSTOCKS

FIELD OF THE INVENTION

The present invention relates to the cracking of hydrocarbons that contain relatively non-volatile hydrocarbons and other contaminants.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products including olefins leave the pyrolysis furnace for further downstream processing, including quenching.

Pyrolysis involves heating the feedstock sufficiently to cause thermal decomposition of the larger molecules. The pyrolysis process, however, produces molecules which tend to combine to form high molecular weight materials known as tar. Tar is a high-boiling point, viscous, reactive material that can foul equipment under certain conditions. In general, feedstocks containing higher boiling materials tend to produce greater quantities of tar.

The formation of tar after the pyrolysis effluent leaves the steam cracking furnace can be minimized by rapidly reducing the temperature of the effluent exiting the pyrolysis unit to a level at which the tar-forming reactions are greatly slowed. This cooling which may be achieved in one or more steps and using one or more methods is referred to as quenching.

Conventional steam cracking systems have been effective for cracking high-quality feedstock which contain a large fraction of light volatile hydrocarbons, such as gas oil and naphtha. However, steam cracking economics sometimes favor cracking lower cost heavy feedstocks such as, by way of non-limiting examples, crude oil and atmospheric residue. Crude oil and atmospheric residue often contain high molecular weight, non-volatile components with boiling points in excess of 1100° F. (590° C.) otherwise known as resids. The non-volatile components of these feedstocks lay down as coke in the convection section of conventional pyrolysis furnaces. Only very low levels of non-volatile components can be tolerated in the convection section downstream of the point where the lighter components have fully vaporized.

Additionally, during transport some naphthas are contaminated with heavy crude oil containing non-volatile components. Conventional pyrolysis furnaces do not have the flexibility to process residues, crudes, or many residue or crude contaminated gas oils or naphthas which are contaminated with non-volatile components.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 and 1100° F. (230 and 590° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking. Periodic regeneration above pyrolysis temperature is effected with air and steam.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

Co-pending U.S. application Ser. No. 10/188461 filed Jul. 3, 2002, patent application Publication US 2004/0004022 A1, published Jan. 8, 2004, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water.

Co-pending U.S. patent application Ser. No. 60/555,282, filed Mar. 22, 2004, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. The amount of fluid mixed with the feedstock is varied in accordance with a selected operating parameter of the process, e.g., temperature of the mixture stream before the mixture stream is flashed, the pressure of the flash, the flow rate of the mixture stream, and/or the excess oxygen in the flue gas of the furnace.

U.S. patent application Ser. No. 10/851,494 filed May 21, 2004. which is incorporated herein by reference describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. Fouling downstream of the flash/separation vessel is reduced by partially condensing the vapor in the upper portion of the vessel.

When heavy resid containing hydrocarbon feeds are used, the feed is preheated in the upper convection section of a pyrolysis furnace, mixed with steam and optionally, water, and then further preheated in the convection section, where the majority of the hydrocarbon vaporizes, but not the resid. This two-phase mist flow stream may pass through a series of pipe bends, reducers, and piping that convert the two-phase mist flow to two-phase stratified open channel flow, i.e., the liquid flows primarily through the bottom cross-section of the pipe and the vapor phase flows primarily though the remaining upper cross-section of the pipe. The stratified open channel flow is introduced through a tangential inlet to a flash/separation apparatus, e.g., a knockout drum, where the vapor and liquid separate. It has been observed that the resulting hydrocarbon/steam vapor phase is at its dew point and is hot enough to crack reducing the vapor temperature by about 8° C. (15° F.) before it is further preheated in the lower convection section and then cracked in the radiant section of the furnace. This cooling effect condenses a portion of the heaviest hydrocarbon. The condensate dehydrogenates into foulant that limits both the time between decoking treatments and the maximum amount of hydrocarbon present as vapor in the flash/separation apparatus. Microscopic analysis of the foulant indicates it is derived from liquid hydrocarbon.

Accordingly, it would be desirable to provide a process for cracking hydrocarbons in which liquid condensation from the vapor in the flash/separation apparatus is reduced or eliminated.

SUMMARY

In one aspect, the present invention relates to a process for cracking a hydrocarbon feedstock containing resid, the process comprising: (a) heating the hydrocarbon feedstock; (b) mixing the heated hydrocarbon feedstock with steam to form a mixture stream; (c) introducing the mixture stream to a flash/separation apparatus to form i) a vapor phase at its dew point which partially cracks causing a temperature decrease and partial condensation of the vapor phase in the absence of added heat, and ii) a liquid phase; (d) reducing or eliminating the partial condensation by adding a heated vaporous diluent to the flash/separation apparatus to an extent sufficient to at least partially compensate for the temperature decrease and to dilute and superheat the vapor phase; (e) removing the vapor phase as overhead and the liquid phase as bottoms from the flash/separation apparatus; (f) indirectly heating the vapor phase, e.g., by convection; (g) cracking the heated vapor phase in a radiant section of a pyrolysis furnace to produce an effluent comprising olefins, the pyrolysis furnace comprising a radiant section and a convection section; and (h) quenching the effluent and recovering cracked product therefrom.

In one embodiment of this aspect of the invention, the heated vaporous diluent is introduced to the flash/separation apparatus above where the mixture stream is introduced.

In another embodiment, the heated vaporous diluent to the flash/separation apparatus is added as at least one of heated light hydrocarbon, e.g., ethane, and superheated steam.

In still another embodiment of this aspect of the invention, the temperature decrease in the absence of the added heated vaporous diluent is at least about 8° C. (15° F.), e.g., at least about 12° C. (22° F.), and the heat added to the vapor/liquid separation apparatus is sufficient to overcome at least about 20%, e.g., at least about 50% of the temperature decrease, or even at least about 100% of the temperature decrease, say, from about 100% to about 200% of the temperature decrease.

In yet another embodiment of this aspect of the invention, the superheated steam has a temperature of at least about 454° C. (850° F.), typically ranging from about 477° C. to about 565° C. (890° F. to 1050° F.).

In still yet another embodiment, the heated vaporous diluent is added to an extent which does not significantly increase liquid entrainment in the vapor phase, such entrainment being measured by sampling the overhead vapor, condensing and analyzing for resid.

In another embodiment of this aspect of the invention, the adding of the heated vaporous diluent increases vapor velocity by no greater than about 30%, typically by no greater than about 10%.

In yet another embodiment, the mixture stream is introduced through a side of the flash/separation apparatus via at least one tangential inlet. Typically, the superheated steam is introduced to the flash/separation apparatus above the tangential inlet.

In still another embodiment, the mixture stream is introduced as a two-phase stratified open channel flow.

In yet another embodiment, the vapor phase throughput for the flash/separation apparatus ranges from about 9000 to about 90,000 kg/hour (20,000 to 200,000 pounds/hour) steam, from about 25,000 to about 80,000 kg/hour (55,000 to 180,000 pounds/hour) hydrocarbons, and the heat is added as from about 45,000 to about 70,000 kg/hour (100,000 to about 150,000 pounds/hour) of superheated steam.

In still another embodiment of this aspect of the invention, the vapor phase throughput for the flash/separation apparatus is about 15000 kg/hour (33000 pounds/hour) steam, about 33000 kg/hour (73000 pounds/hour) hydrocarbons and the heat is added as about 2700 kg/hour (about 6000 pounds/hour) of superheated steam.

In still yet another embodiment of the invention, the flash/separation apparatus comprises a cooling coil for partially condensing the vapor phase above where the mixture stream is introduced.

In still another aspect, the present invention further comprises providing a set of passive vapor/liquid contacting surfaces below the cooling coil and above where the mixture stream is introduced. Typically, the set of vapor/liquid contacting surfaces are sheds. Alternately, a Glitsch Grid can be used.

In still another embodiment, the indirect heating of the vapor phase is carried out by convection heating. Typically, the indirect heating of the vapor phase is carried out by contacting the vapor phase with a heated tube bank in the convection section of the pyrolysis furnace.

In another aspect, the present invention relates to a flash/separation vessel for treating hydrocarbon feedstock containing resid to provide a liquid phase and a vapor phase which comprises: (A) an inlet for introducing the hydrocarbon feedstock; (B) an inlet for adding heated vaporous diluent to the flash/separation vessel to dilute the vapor phase; (C) a flash/separation vessel overhead outlet for removing the vapor phase as overhead; and (D) a flash/separation vessel liquid outlet for removing the liquid phase as bottoms from the flash/separation vessel.

In one embodiment of this aspect of the invention, the flash/separation vessel further comprises an inlet for introducing the heated vaporous diluent to the flash/separation vessel located above the inlet for introducing the hydrocarbon feedstock. Typically, the heated vaporous diluent to the flash/separation vessel is added as at least one of heated light hydrocarbon, e.g., ethane, and superheated steam.

In another embodiment, the flash/separation vessel comprises an inlet through which the heated vaporous diluent is added to the flash/separation vessel as superheated steam.

In still another embodiment, the flash/separation vessel comprises at least one tangential inlet for introducing the hydrocarbon feedstock through a side of the flash/separation vessel.

In another embodiment, the flash/separation vessel comprises an inlet for introducing steam to the flash/separation vessel above the tangential inlet.

In yet another embodiment, the flash/separation vessel further comprises a cooling coil for partially condensing the vapor phase located above the inlet where the hydrocarbon feedstock is introduced.

In still yet another embodiment of the present invention, the flash/separation vessel further comprises sheds positioned below the cooling coil and above the inlet where the hydrocarbon feedstock is introduced.

In another aspect, the present invention relates to an apparatus for cracking a hydrocarbon feedstock containing resid, the apparatus comprising: (1) a convection heater for heating the hydrocarbon feedstock; (2) an inlet for introducing steam to the heated hydrocarbon feedstock to form a mixture stream; (3) a flash/separation drum for treating the mixture stream to form i) a vapor phase at its dew point which partially cracks causing a temperature decrease and partial condensation of the vapor phase in the absence of added heat, and ii) a liquid phase; the drum further comprising (I) a means for reducing or eliminating the partial condensation comprising an inlet for adding heated vaporous diluent to the flash/separation drum to an extent sufficient to at least partially compensate for the temperature decrease and dilute and superheat the vapor phase; (II) a flash/separation drum overhead outlet for removing the vapor phase as overhead; (III) a flash/separation drum liquid outlet for removing the liquid phase as bottoms from the flash/separation drum; (4) a convection heater for heating the vapor phase; (5) a pyrolysis furnace comprising a radiant section for cracking the heated vapor phase to produce an effluent comprising olefins, and a convection section; and (6) means for quenching the effluent and recovering cracked product therefrom.

In one embodiment of this aspect of the present invention, the heated vaporous diluent is introduced to the flash/separation drum through an inlet above where the mixture stream is introduced. Typically, the heated vaporous diluent to the flash/separation drum is added as at least one of heated light hydrocarbon and superheated steam.

In still another embodiment, the apparatus of the invention comprises at least one tangential inlet for introducing the mixture stream through a side of the flash/separation drum. Typically, the apparatus comprises an inlet for introducing steam to the flash/separation drum above the tangential inlet.

In still yet another embodiment, the flash/separation drum of the apparatus further comprises a cooling coil for partially condensing the vapor phase above the inlet where the mixture stream is introduced. Typically, the flash/separation drum further comprises liquid/vapor contacting surfaces, e.g., sheds, positioned below the cooling coil and above the inlet where the mixture stream is introduced.

The hydrocarbon feedstock with resid for use with the present invention typically comprises one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, hydrocarbon gases/residue admixtures, hydrogen/residue admixtures C4's/residue admixture, naphtha/residue admixture and gas oil/residue admixture.

In one embodiment of this aspect of the invention, the hydrocarbon feedstock with resid has a nominal final boiling point of at least about 315° C. (600° F.).

In applying this invention, the hydrocarbon feedstock containing resid may be initially heated by indirect contact with flue gas in a first convection section tube bank of the pyrolysis furnace before mixing with a fluid, e g., steam. Preferably, the temperature of the heavy hydrocarbon feedstock is from 150° C. to 260° C. (300° F. to 500° F.) before mixing with the fluid.

Following mixing with the primary dilution steam stream, the mixture stream may be heated by indirect contact with flue gas in a first convection section of the pyrolysis furnace before being flashed. Preferably, the first convection section is arranged to add the primary dilution steam stream, between subsections of that section such that the hydrocarbon feedstock can be heated before mixing with the fluid and the mixture stream can be further heated before being flashed.

The temperature of the flue gas entering the first convection section tube bank is generally less than about 815° C. (1500° F.), for example, less than about 705° C. (1300° F.), such as less than about 620° (1150° F.), and preferably less than about 540° C. (1000° F.).

Dilution steam may be added at any point in the process, for example, it may be added to the hydrocarbon feedstock before or after heating, to the mixture stream, and/or to the vapor phase. Any dilution steam stream may comprise sour steam. Any dilution steam stream may be heated or superheated in a convection section tube bank located anywhere within the convection section of the furnace, preferably in the first or second tube bank The mixture stream may be at about 315 to 540° C. (600° F. to about 1000° F.) before the flash in step (c), and the flash pressure may be about 275 to about 1375 kPa (40 to 200 psia). Following the flash, 50 to 98% of the mixture stream may be in the vapor phase. An additional separator such as a centrifugal separator may be used to remove trace amounts of liquid from the vapor phase. The vapor phase may be heated to above the flash temperature before entering the radiant section of the furnace, for example, to about 425 to 705° C. (800 to 1300° F.). This heating may occur in a convection section tube bank, preferably the tube bank nearest the radiant section of the furnace.

A transfer line exchanger can be used to produce high pressure steam which is then preferably superheated in a convection section tube bank of the pyrolysis furnace, typically to a temperature less than about 590° C. (1100° F.), for example, about 455 to about 510° C. (850 to 950° F.) by indirect contact with the flue gas before the flue gas enters the convection section tube bank used for heating the heavy hydrocarbon feedstock and/or mixture stream. An intermediate desuperheater may be used to control the temperature of the high pressure steam. The high pressure steam is preferably at a pressure of about 4240 kPa (600 psig) or greater and may have a pressure of about 10450 to about 13900 kPa (1500 to 2000 psig). The high pressure steam superheater tube bank is preferably located between the first convection section tube bank and the tube bank used for heating the vapor phase.

BRIEF DESCRIPTION OF THE DRAWING

FIG. 1 illustrates a schematic flow diagram of the overall process and apparatus in accordance with the present invention employed with a pyrolysis furnace.

DETAILED DESCRIPTION

Unless otherwise stated, all percentages, parts, ratios, etc. are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, resids are non-volatile components, e.g., the fraction of the hydrocarbon feed with a nominal boiling point above about 1100° F. (590° C.) as measured by ASTM D-6352-98 or D-2887. This invention works very well with non-volatiles having a nominal boiling point above about 1400° F. (760° C.). The boiling point distribution of the hydrocarbon feed is measured by Gas Chromatograph Distillation (GCD) by ASTM D-6352-98 or D-2887 extended by extrapolation for materials boiling above 700° C. (1292° F.). Non-volatiles include coke precursors which are large, condensable molecules in the vapor which condense, and then form coke under the operating conditions encountered in the present process of the invention.

The present invention relates to a process for heating and steam cracking hydrocarbon feedstock containing resid. The process comprises heating the hydrocarbon feedstock, mixing the hydrocarbon feedstock with a fluid to form a mixture, flashing the mixture to form a vapor phase and a liquid phase, feeding the vapor phase to the radiant section of a pyrolysis furnace, and subsequently quenching the reaction, e.g., by using a transfer line exchanger.

The heating of the hydrocarbon feedstock can take any form known by those of ordinary skill in the art. However, it is preferred that the heating comprises indirect contact of the hydrocarbon feedstock in the upper (farthest from the radiant section) convection section tube bank 2 of the furnace 1 with hot flue gases from the radiant section of the furnace. This can be accomplished, by way of non-limiting example, by passing the hydrocarbon feedstock through a bank of heat exchange tubes 2 located within the convection section 3 of the furnace 1. The heated hydrocarbon feedstock typically has a temperature between about 150 and about 260° C. (300 to 500° F.), such as about 160 to about 230° C. (325 to 450° F.), for example, about 170 to about 220° C. (340 to 425° F.).

The heated hydrocarbon feedstock is mixed with primary dilution steam and optionally, a fluid which can be a hydrocarbon (preferably liquid but optionally vapor), water, steam, or a mixture thereof. The preferred fluid is water. A source of the fluid can be low pressure boiler feed water. The temperature of the fluid can be below, equal to, or above the temperature of the heated feedstock.

The mixing of the heated hydrocarbon feedstock and the fluid can occur inside or outside the pyrolysis furnace 1, but preferably it occurs outside the furnace. The mixing can be accomplished using any mixing device known within the art. For example, it is possible to use a first sparger 4 of a double sparger assembly 9 for the mixing. The first sparger 4 can avoid or reduce hammering, caused by sudden vaporization of the fluid, upon introduction of the fluid into the heated hydrocarbon feedstock.

The present invention uses steam streams in various parts of the process. The primary dilution steam stream 17 can be mixed with the heated hydrocarbon feedstock as detailed below. In another embodiment, a secondary dilution steam stream 18 can be heated in the convection section and mixed with the heated mixture steam before the flash. The source of the secondary dilution steam may be primary dilution steam which has been superheated, optionally in a convection section of the pyrolysis furnace. Either or both of the primary and secondary dilution steam streams may comprise sour steam. Superheating the sour dilution steam minimizes the risk of corrosion which could result from condensation of sour steam.

In one embodiment of the present invention, in addition to the fluid mixed with the heated feedstock, the primary dilution steam 17 is also mixed with the feedstock. The primary dilution steam stream can be preferably injected into a second sparger 8. It is preferred that the primary dilution steam stream is injected into the hydrocarbon fluid mixture before the resulting stream mixture optionally enters the convection section at 11 for additional heating by flue gas, generally within the same tube bank as would have been used for heating the hydrocarbon feedstock.

The primary dilution steam can have a temperature greater, lower or about the same as hydrocarbon feedstock fluid mixture but preferably the temperature is greater than that of the mixture and serves to partially vaporize the feedstock/fluid mixture. The primary dilution steam may be superheated before being injected into the second sparger 8.

The mixture stream comprising the heated hydrocarbon feedstock, the fluid, and the primary dilution steam stream leaving the second sparger 8 is optionally heated again in the convection section of the pyrolysis furnace 3 before the flash. The heating can be accomplished, by way of non-limiting example, by passing the mixture stream through a bank of heat exchange tubes 6 located within the convection section, usually as part of the first convection section tube bank, of the furnace and thus heated by the hot flue gas from the radiant section of the furnace. The thus-heated mixture stream leaves the convection section as a mixture stream 12 to optionally be further mixed with an additional steam stream.

Optionally, the secondary dilution steam stream 18 can be further split into a flash steam stream 19 which is mixed with the hydrocarbon mixture 12 before the flash and a bypass steam stream 21 which bypasses the flash of the hydrocarbon mixture and, instead is mixed with the vapor phase from the flash before the vapor phase is cracked in the radiant section of the furnace. The present invention can operate with all secondary dilution steam 18 used as flash steam 19 with no bypass steam 21. Alternatively, the present invention can be operated with secondary dilution steam 18 directed to bypass steam 21 with no flash steam 19. In a preferred embodiment in accordance with the present invention, the ratio of the flash steam stream 19 to bypass steam stream 21 should be preferably 1:20 to 20:1, and most preferably 1:2 to 2:1. In this embodiment, the flash steam 19 is mixed with the hydrocarbon mixture stream 12 to form a flash stream 20 which typically is introduced before the flash in flash/separation vessel 5. Preferably, the secondary dilution steam stream is superheated in a superheater section 16 in the furnace convection before splitting and mixing with the hydrocarbon mixture. The addition of the flash steam stream 19 to the hydrocarbon mixture stream 12 aids the vaporization of most volatile components of the mixture before the flash stream 20 enters the flash/separator vessel 5.

The mixture stream 12 or the flash stream 20 is then introduced for flashing, either directly or through a tangential inlet (to impart swirl) to a flash/separation apparatus, e.g., flash/separator vessel 5, for separation into two phases: a vapor phase comprising predominantly volatile hydrocarbons and steam and a liquid phase comprising predominantly non-volatile hydrocarbons. The vapor phase is preferably removed from the flash/separator vessel as an overhead vapor stream 13. The vapor phase, preferably, is fed back to a convection section tube bank 23 of the furnace, preferably located nearest the radiant section of the furnace, for optional heating and through crossover pipes 24 to the radiant section of the pyrolysis furnace for cracking. The liquid phase of the flashed mixture stream is removed from the flash/separator vessel 5 as a bottoms stream 27.

It is preferred to maintain a predetermined constant ratio of vapor to liquid in the flash/separator vessel 5, but such ratio is difficult to measure and control. As an alternative, temperature of the mixture stream 12 before the flash/separator vessel 5 can be used as an indirect parameter to measure, control, and maintain an approximately constant vapor to liquid ratio in the flash/separator vessel 5. Ideally, when the mixture stream temperature is higher, more volatile hydrocarbons will be vaporized and become available, as a vapor phase, for cracking. However, when the mixture stream temperature is too high, more heavy hydrocarbons will be present in the vapor phase and carried over to the convection furnace tubes, eventually coking the tubes. If the mixture stream 12 temperature is too low, resulting in a low ratio of vapor to liquid in the flash/separator vessel 5, more volatile hydrocarbons will remain in liquid phase and thus will not be available for cracking.

The mixture stream temperature is limited by highest recovery/vaporization of volatiles in the feedstock while avoiding excessive coking in the furnace tubes or coking in piping and vessels conveying the mixture from the flash/separator vessel to the furnace 1 via line 13. The pressure drop across the vessels and piping 13 conveying the mixture to the lower convection section 23, and the crossover piping 24, and the temperature rise across the lower convection section 23 may be monitored to detect the onset of coking problems. For instance, when the crossover pressure and process inlet pressure to the lower convection section 23 begins to increase rapidly due to coking, the temperature in the flash/separator vessel 5 and the mixture stream 12 should be reduced. If coking occurs in the lower convection section, the temperature of the flue gas to the superheater 16 increases, requiring more desuperheater water 26.

The selection of the mixture stream 12 temperature is also determined by the composition of the feedstock materials. When the feedstock contains higher amounts of lighter, hydrocarbons, the temperature of the mixture stream 12 can be set lower. As a result, the amount of fluid used in the first sparger 4 would be increased and/or the amount of primary dilution steam used in the second sparger 8 would be decreased since these amounts directly impact the temperature of the mixture stream 12. When the feedstock contains a higher amount of non-volatile hydrocarbons, the temperature of the mixture stream 12 should be set higher. As a result, the amount of fluid used in the first sparger 4 would be decreased while the amount of primary dilution steam used in the second sparger 8 would be increased. By carefully selecting a mixture stream temperature, the present invention can find applications in a wide variety of feedstock materials.

Typically, the temperature of the mixture stream 12 can be set and controlled at between about 315 and about 540° C. (600 and 1000° F.), such as between about 370 and about 510° C. (700 and 950° F.), for example, between about 400 and about 480° C. (750 and 900° F.), and often between about 430 and about 475° C. (810 and 890° F.). These values will change with the concentration of volatiles in the feedstock as discussed above.

Considerations in determining the temperature include the desire to maintain a liquid phase to reduce the likelihood of coke formation on exchanger tube walls and in the flash/separator.

The temperature of mixture stream 12 can be controlled by a control system 7 which comprises at least a temperature sensor and any known control device, such as a computer application. Preferably, the temperature sensors are thermocouples. The control system 7 communicates with the fluid valve 14 and the primary dilution steam valve 15 so that the amount of the fluid and the primary dilution steam entering the two spargers can be controlled.

In order to maintain a constant temperature for the mixture stream 12 mixing with flash steam 19 and entering the flash/separator vessel to achieve a constant ratio of vapor to liquid in the flash/separator vessel 5, and to avoid substantial temperature and flash vapor to liquid ratio variations, the present invention operates as follows: When a temperature for the mixture stream 12 before the flash/separator vessel 5 is set, the control system 7 automatically controls the fluid valve 14 and primary dilution steam valve 15 on the two spargers. When the control system 7 detects a drop of temperature of the mixture stream, it will cause the fluid valve 14 to reduce the injection of the fluid into the first sparger 4. If the temperature of the mixture stream starts to rise, the fluid valve will be opened wider to increase the injection of the fluid into the first sparger 4. In one possible embodiment, the fluid latent heat of vaporization controls mixture stream temperature.

When the primary dilution steam stream 17 is injected to the second sparger 8, the temperature control system 7 can also be used to control the primary dilution steam valve 15 to adjust the amount of primary dilution steam stream injected to the second sparger 8. This further reduces the sharp variation of temperature changes in the flash 5. When the control system 7 detects a drop of temperature of the mixture stream 12, it will instruct the primary dilution steam valve 15 to increase the injection of the primary dilution steam stream into the second sparger 8 while valve 14 is closed more. If the temperature starts to rise, the primary dilution steam valve will automatically close more to reduce the primary dilution steam stream injected into the second sparger 8 while valve 14 is opened wider.

In one embodiment in accordance with the present invention, the control system 7 can be used to control both the amount of the fluid and the amount of the primary dilution steam stream to be injected into both spargers.

In an example embodiment where the fluid is water, the controller varies the amount of water and primary dilution steam to maintain a constant mixture stream temperature 12, while maintaining a constant ratio of water-to-feedstock in the mixture 11. To further avoid sharp variation of the flash temperature, the present invention also preferably utilizes an intermediate desuperheater 25 in the superheating section of the secondary dilution steam in the furnace. This allows the superheater 16 outlet temperature to be controlled at a constant value, independent of furnace load changes, coking extent changes, excess oxygen level changes, and other variables. Normally, this desuperheater 25 maintains the temperature of the secondary dilution steam between about 425 and about 590° C. (800 and 1100° F.), for example, between about 455 and about 540° C. (850 and 1000° F.), such as between about 455 and about 510° C. (850 and 950° F.), and typically between about 470 and about 495° C. (875 and 925° F.). The desuperheater can be a control valve and water atomizer nozzle. After partial preheating, the secondary dilution steam exits the convection section and a fine mist of water 26 can be added which rapidly vaporizes and reduces the temperature. The steam is preferably then further heated in the convection section. The amount of water added to the superheater can control the temperature of the steam which is mixed with mixture stream 12.

Although the description above is based on adjusting the amounts of the fluid and the primary dilution steam streams injected into the hydrocarbon feedstock in the two spargers 4 and 8, according to the predetermined temperature of the mixture stream 12 before the flash/separator vessel 5, the same control mechanisms can be applied to other parameters at other locations. For instance, the flash pressure and the temperature and the flow rate of the flash steam 19 can be changed to effect a change in the vapor to liquid ratio in the flash. Also, excess oxygen in the flue gas can also be a control variable, albeit possibly a slow one.

In addition to maintaining a constant temperature of the mixture stream 12 entering the flash/separator vessel, it is generally also desirable to maintain a constant hydrocarbon partial pressure of the flash stream 20 in order to maintain a constant ratio of vapor to liquid in the flash/separator vessel. By way of examples, the constant hydrocarbon partial pressure can be maintained by maintaining constant flash/separator vessel pressure through the use of control valves 36 on the vapor phase line 13, and by controlling the ratio of steam to hydrocarbon feedstock in stream 20.

Typically, the hydrocarbon partial pressure of the flash stream in the present invention is set and controlled at between about 4 and about 25 psia (25 and 175 kPa), such as between about 5 and about 15 psia (35 and 100 kPa), for example, between about 6 and about 11 psia (40 and 75 kPa).

In one embodiment, the flash is conducted in at least one flash/separator vessel. Typically the flash is a one-stage process with or without reflux. The flash/separator vessel 5 is normally operated at about 275 to 1400 kPa (40 to 200 psia) pressure and its temperature is usually the same or slightly lower than the temperature of the flash stream 20 via the flash/separation apparatus feed inlet before entering the flash/separator vessel 5. Typically, the pressure at which the flash/separator vessel operates is at about 275 to about 1400 kPa (40 to 200 psia) and the temperature is at about 310 to about 540° C. (600 to 1000° F.). For example, the pressure of the flash can be about 600 to about 1100 kPa (85 to 155 psia) and the temperature can be about 370 to about 490° C. (700 to 920° F.). As a further example, the pressure of the flash can be about 700 to about 1000 kPa (105 to 145 psia) with a temperature of about 400 to about 480° C. (750 to 900° F.). In yet another example, the pressure of the flash/separator vessel can be about 700 to about 760 kPa (105 to 125 psia) and the temperature can be about 430 to about 475° C. (810 to 890° F.). Depending on the temperature of the mixture stream 12, generally about 50 to about 98% of the mixture stream being flashed is in the vapor phase, such as about 60 to about 95%, for example, about 65 to about 90%.

The flash/separator vessel 5 is generally operated, in one aspect, to minimize the temperature of the liquid phase at the bottom of the vessel because too much heat may cause coking of the non-volatiles in the liquid phase. Use of the secondary dilution steam stream 18 in the flash stream entering the flash/separator vessel lowers the vaporization temperature because it reduces the partial pressure of the hydrocarbons (i.e., a larger mole fraction of the vapor is steam) and thus lowers the required liquid phase temperature. It may also be helpful to recycle a portion of the externally cooled flash/separator vessel bottoms liquid 30 back to the flash/separator vessel to help cool the newly separated liquid phase at the bottom of the flash/separator vessel 5. Stream 27 can be conveyed from the bottom of the flash/separator vessel 5 to the cooler 28 via pump 37. The cooled stream 29 can then be split into a recycle stream 30 and export stream 22. The temperature of the recycled stream would typically be about 260 to about 315° C. (500 to 600° F.), for example, about 270 to about 290° C. (520 to 550° F.). The amount of recycled stream can be about 80 to about 250% of the amount of the newly separated bottom liquid inside the flash/separator vessel, such as 90 to 225%, for example, 100 to 200%.

The flash is generally also operated, in another aspect, to minimize the liquid retention/holding time in the flash vessel. In one example embodiment, the liquid phase is discharged from the vessel through a small diameter "boot" or cylinder 35 on the bottom of the flash/separator vessel. Typically, the liquid phase retention time in the drum is less than about 75 seconds, for example, less than about 60 seconds, such as less than about 30 seconds, and often less than about 15 seconds. The shorter the liquid phase retention/holding time in the flash/separator vessel, the less coking occurs in the bottom of the flash/separator vessel.

Inasmuch as the present invention relates to controlling partial condensation of the vapor phase within the flash/separator vessel 5, it is noted that endothermic cracking reactions which occur within the flash/separator vessel cause a lowering of the vapor phase temperature and an attendant condensation of heavier components within the vapor phase. In order to minimize such condensation and the resulting undesired passage of condensed vapor coke precursors as overhead component via line 13, a heated diluent is added to the flash/separator vessel. The diluent may be added as steam, via line 100 at a point above the hydrocarbon feed inlet 20, and/or as heated hydrocarbon, e.g., ethane, via line 102. In one embodiment, a surface for vapor/liquid contacting, e.g., cooling coil 104 is positioned within the flash/separator vessel 5 above 100 and 102. The cooling coil receives coolant via coolant inlet 108 which coolant is removed via coolant outlet 110. Suitable coolants include steam and water. Preferably, the coolant when introduced to the flash/separator vessel has a temperature of no greater than about 450° C., say, from about 150 to about 260° C. A set of passive vapor/liquid contacting surfaces 106, e.g., sheds, can placed below the cooling coil 104 and above where the feed stream 20 is introduced. Such surfaces can improve separation of heavy condensable molecules from overheads.

The vapor phase taken as overhead from the flash/separation apparatus 5 via 13 may contain, for example, 55 to 70% hydrocarbons and 30 to 45% steam. The boiling end point of the vapor phase is normally below about 1400° F. (760° C.), such as below about 1100° F. (590° C.), for example, below about 1050° F. (565° C.), and often below about 1000° F. (540° C.). The vapor phase is continuously removed from the flash/separator vessel 5 through an overhead pipe, which optionally conveys the vapor to a centrifugal separator 38 to remove trace amounts of entrained and/or condensed liquid. The vapor then typically flows into a manifold that distributes the flow to the convection section of the furnace.

The vapor phase stream 13 continuously removed from the flash/separator vessel is preferably superheated in the pyrolysis furnace lower convection section 23 to a temperature of, for example, about 425 to about 705° C. (800 to about 1300° F.) by the flue gas from the radiant section of the furnace. The vapor phase is then introduced to the radiant section of the pyrolysis furnace to be cracked.

The vapor phase stream 13 removed from the flash/separator vessel can optionally be mixed with a bypass steam stream 21 before being introduced into the furnace lower convection section 23.

The bypass steam stream 21 is a split steam stream from the secondary dilution steam 18. Preferably, the secondary dilution steam is first heated in the convection section of the pyrolysis furnace 3 before splitting and mixing with the vapor phase stream removed from the flash 5. In some applications, it may be possible to superheat the bypass steam again after the splitting from the secondary dilution steam but before mixing with the vapor phase. The superheating after the mixing of the bypass steam 21 with the vapor phase stream 13 ensures that all but the heaviest components of the mixture in this section of the furnace are vaporized before entering the radiant section. Raising the temperature of vapor phase from about 800 to about 1300° F. (425 to 705° C.) in the lower convection section 23 also helps the operation in the radiant section since radiant tube metal temperature can be reduced. This results in less coking potential in the radiant section. The superheated vapor is then cracked in the radiant section of the pyrolysis furnace.

Because the controlled flash of the mixture stream results in significant removal of the coke- and tar-producing heavier hydrocarbon species (in the liquid phase), it is possible to utilize a transfer line exchanger for quenching the effluent from the radiant section of the pyrolysis furnace. Among other benefits, this will allow more cost-effective retrofitting of cracking facilities initially designed for lighter feeds, such as naphthas, or other liquid feedstocks with end boiling points generally below about 315° C. (600° F.), which have transfer line exchanger quench systems already in place.

After being cooled in the transfer line exchanger, the furnace effluent may optionally be further cooled by injection of a stream of suitable quality quench oil.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

I claim:

1. A process for cracking a hydrocarbon feedstock containing resid, said process comprising:

(a) heating said hydrocarbon feedstock;

(b) mixing the heated hydrocarbon feedstock with steam to form a mixture stream;

(c) introducing the mixture stream to a flash/separation apparatus to form i) a vapor phase at its dew point which partially cracks causing a temperature decrease and partial condensation of said vapor phase in the absence of added heat, and ii) a liquid phase;

(d) reduciug or eliminating said partial condensation by adding a heated vaporous diluent to said flash/separation apparatus to an extent sufficient to at least partially compensate for said temperature decrease and to dilute and superheat said vapor phase;

(e) removing the vapor phase as overhead and said liquid phase as bottoms from said flash/separation apparatus;

(f) indirectly heating the vapor phase;

(g) cracking the heated vapor phase in a radiant section of a pyrolysis furnace to produce an effluent comprising olefins, said pyrolysis furnace comprising a radiant section and a convection section; and (h) quenching the effluent and recovering cracked product therefrom.

2. The process of claim 1 wherein said heated vaporous diluent is introduced to said flash/separation apparatus above where said mixture stream is introduced.

3. The process of claim 1 wherein said heated vaporous diluent to said flash/separation apparatus is added as at least one of heated light hydrocarbon and superheated steam.

4. The process of claim 3 wherein said light hydrocarbon is ethane.

5. The process of claim 1 wherein said heated vaporous diluent is added to said flash/separation apparatus as superheated steam.

6. The process of claim 1 wherein said temperature decrease in the absence of said added heated vaporous diluent is at least about 12° C. (22° F.) and said heat added to said vapor/liquid separation apparatus is sufficient to overcome at least about 20% of said temperature decrease.

7. The process of claim 1 wherein said temperature decrease in the absence of added heat is at least about 8° C. (15° F.) and said heated vaporous diluent added to said vapor/liquid separation apparatus is sufficient to overcome at least about 50% of said temperature decrease.

8. The process of claim 7 wherein said heated vaporous diluent added to said vapor/liquid separation apparatus is sufficient to overcome at least about 100% of said temperature decrease.

9. The process of claim 8 wherein said heated vaporous diluent added to said vapor/liquid separation apparatus is sufficient to overcome from about 100% to about 200% of said temperature decrease.

10. The process of claim 5 wherein said superheated steam has a temperature of at least about 454° C. (850° F.).

11. The process of claim 10 wherein said superheated steam has a temperature ranging from about 477° C. to about 565° C. (890° F. to 1050° F.

12. The process of claim 1 wherein said heated vaporous diluent is added to an extent which does not significantly increase liquid entrainment in said vapor phase.

13. The process of claim 11 wherein adding said heated vaporous diluent increases vapor velocity by no greater than about 30%.

14. The process of claim 13 wherein adding said heated vaporous diluent increases vapor velocity by no greater than about 10%.

15. The process of claim 1 wherein said mixture stream is introduced through a side of said flash/separation apparatus via at least one tangential inlet.

16. The process of claim 15 wherein said steam is introduced to said flash/separation apparatus above said tangential inlet.

17. The process of claim 1 wherein said mixture stream is introduced as a two-phase stratified open channel flow.

18. The process of claim 1 wherein said vapor phase throughput for said flash/separation apparatus ranges from about 9000 to about 90,000 kg/hour (20,000 to 200,000 pounds/hour) steam, from about 25,000 to about 80,000 kg/hour (55,000 to 180,000 pounds/hour) hydrocarbons, and said heat is added as from about 45,000 to about 70,000 kg/hour (100,000 to about 150,000 pounds/hour) of superheated steam.

19. The process of claim 1 wherein said vapor phase throughput for said flash/separation apparatus is about 15000 kg/hour (33000 pounds/hour) steam, about 33000 kg/hour (73000 ponds/hour) hydrocarbons and said heat is added as about 2700 kg/hour (about 6000 pounds/hour) of superheated steam.

20. The process of claim 1 wherein said flash/separation apparatus comprises a cooling coil for partially condensing said vapor phase above where said mixture stream is introduced.

21. The process of claim 20 which further comprises providing a set of passive vapor/liquid contacting surfaces below said cooling coil end above where said mixture stream is introduced.

22. The process of claim 21 wherein said set of vapor/liquid contacting surfaces are sheds.

23. The process of claim 1 wherein said indirect heating of said vapor phase is carried out by convection heating.

24. The process of claim 23 wherein said indirect heating of said vapor phase is carried out by contacting said vapor phase with a heated tube bank in the convection section of the pyrolysis furnace.

* * * * *